United States Patent [19]

Adams et al.

[11] 3,933,116

[45] Jan. 20, 1976

[54] UNITARY PROPELLING AND STEERING ASSEMBLY FOR A POWER BOAT

[75] Inventors: Thomas F. Adams, Hallandale; Douglas W. Janisch; William L. Sirois, both of Fort Lauderdale, all of Fla.

[73] Assignees: Thomas F. Adams, Hollandale; Douglas W. Janisch; William L. Sirois, both of Fort Lauderdale, Fla.

[22] Filed: Dec. 2, 1974

[21] Appl. No.: 528,946

[52] U.S. Cl. ..... 115/35; 115/41 HT

[51] Int. Cl.[2] ..... B63H 24/42

[58] Field of Search ..... 115/34 R, 35, 41 R, 41 HT

[56] References Cited

UNITED STATES PATENTS

| | | | |
|---|---|---|---|
| 3,057,320 | 10/1962 | Daniels | 115/35 |
| 3,136,287 | 6/1964 | North | 115/41 R |
| 3,376,842 | 4/1968 | Wynne | 115/41 R |
| 3,430,603 | 3/1969 | Parish | 115/35 |
| 3,626,467 | 12/1971 | Mazziotti | 115/41 HT |

*Primary Examiner*—Trygve M. Blix
*Assistant Examiner*—Jesus D. Sotelo
*Attorney, Agent, or Firm*—Gustave Miller

[57] ABSTRACT

This is a motor boat gimbal controlled propelling and steering device extending through the boat wall or transom. In one form the power thrust is substantially in direct line with the motor shaft of the inboard motor, the motor being at about the same angle as the propeller shaft, and, in another form, a horizontal inboard motor is connected by a pair of bevel gears at a slight angle to the propeller shaft. The propeller shaft and propeller are used to steer the boat, the propeller shaft being connected to the motor shaft through a gimbal by a universal joint sealed within a tubular accordion boot so that it may swing horizontally for steering purposes and may also swing vertically to a position to at least just clear the bottom hull line and propel the boat in water just enough to float the boat. A conventional surfacing type of propeller is used to provide the optimum effect, particularly in shallow water. The propeller end of the propeller shaft is supported through a bearing box secured on the bottom of an anti-cavitation plate having a vertical fin thereabove/and below secured thereto, and a hydraulic pressure piston and cylinder are used as a trim control to vertically position the propeller, the cylinder being connected to the fin at one end and to the top of a gimbal support frame which in turn is secured externally to the boat wall or transom. A propeller shaft bearing box is horizontally pivoted to a gimbal ring, which ring is vertically pivoted in the gimbal support frame. A tiller is secured on the gimbal ring vertical pivot shaft for swinging the propeller shaft horizontally for steering, and the propeller shaft trim control lifting and depressing control pressure cylinder is connected to the propeller bearing boxes and to the tiller shaft for lifting the propeller to above the hull line.

15 Claims, 7 Drawing Figures

UNITARY PROPELLING AND STEERING ASSEMBLY FOR A POWER BOAT

BACKGROUND OF THE INVENTION

Inboard-outboard power drives are of many types, the most common now in use being a type wherein a shaft extends through the transom of the boat, and then is connected by a gear set to a vertical shaft and then a second gear set to the actual propeller shaft. Other prior art does show direct drive of the propeller shaft by the motor.

OBJECTS OF THIS INVENTION

It is an object of this invention to provide direct drive or substantially direct drive through the boat wall or transom which also provides steering and eliminates any separate rudder arrangement.

Still a further object of this invention is to provide a power drive through the transom of a boat wherein a surface type of propeller is preferably used and wherein the propeller may be lifted enough in shallow water so that it is entirely above the boat hull line, yet still provides a sufficient amount of power for shallow water travel.

Yet a further object of this invention is to provide a gimbal support frame secured externally on the boat wall or transom through which the propeller shaft extends and a gimbal thereon providing vertical and horizontal swinging of the propeller shaft for shallow water navigation and for steering the boat.

Another object of this invention is to provide a propeller shaft having a double yoke universal joint permitting the shaft to be swung both horizontally and vertically for steering and for shallow water navigation.

A still further object of this invention is to provide a universally jointed propeller shaft and a gimbal support for the propeller shaft therethrough and through the boat wall or transom providing both horizontal and vertical control both to steer the boat and provide shallow water drive when needed.

Still a further object of this invention is to provide a strong but flexible coupler between the propeller shaft and the gear box.

Another object of this invention is to provide a substantially direct drive propeller through the boat wall or transom yet where the propeller shaft is controllably swingable both horizontally and vertically.

A further object of this invention is to provide an improved substantially direct power drive that is an improvement over the prior art including U.S. Pat. Nos. 2,265,079; 2,370,212; 2,415,183; 2,961,988; 3,057,320; 3,136,287; 3,368,516; 3,368,517; 3,382,838; 3,487,804; 3,826,219.

BRIEF DESCRIPTION OF THE DRAWINGS

With the above and related objects in view, this invention consists in the details of construction and combination of parts, as will be more fully understood from the following description, when read in conjunction with the accompanying drawings, wherein.

DETAILED DESCRIPTION OF THE INVENTION

Figure 1:
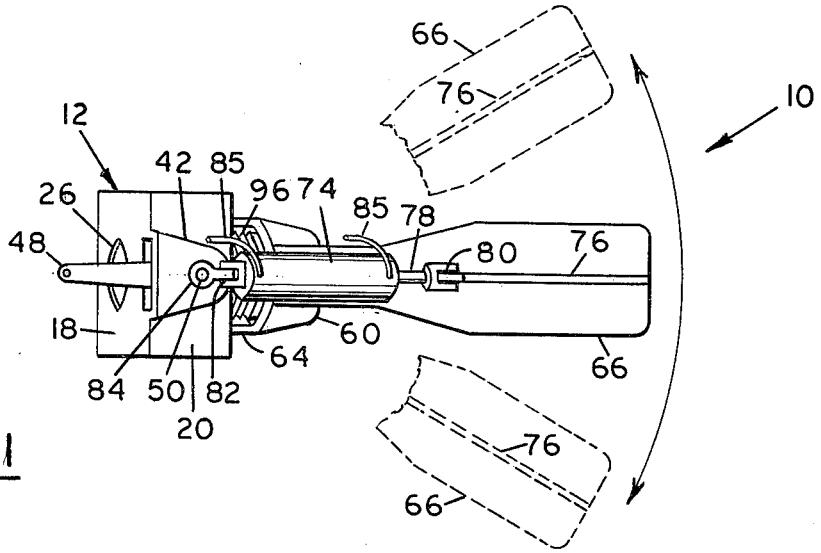
FIG. 1 is a top plan view of the boat motor drive of this invention, also showing the steering limits thereof.

There is shown at 10 the gimbal controlled motor drive of this invention, wherein a gimbal support frame 12 is mounted externally on the boat wall or transom 14 extending up from the rear of the boat hull 16. The gimbal support frame 12 is shaped substantially as shown, having a forward wall 18 at an angle to its horizontal top and bottom walls 20 and 22 and vertical side walls 24. The forward wall 18 is provided with an aperture cylinder 26 therethrough aligned with a shaft opening 28 in the transom 14 so that the propeller shaft 30 may be operatively coupled to a gear shift and gear reduction box 32 and thus to the motor 34. The gimbal support frame wall 18 is secured to the transom 14 by bolts and nuts 36 through the transom 14 and a reinforcing plate 38 on the inside of the transom 14, the plate 38 having a corresponding aperature at 40. A shaft coupler 31 is provided if needed to facilitate assembly.

Integrally mounted on the frame top wall 22 is a V-shaped tiller compartment 42 having its V opening aligned with a corresponding tiller opening 44 in the transom 14 and opening 46 in the reinforcing plate 32. A boat tiller 48 is secured through the compartment 42 on a vertical shaft 50 journaled through the compartment 42 and the frame top wall 20 and secured to the top portion 52 of a vertical gimbal ring 54, the bottom gimbal ring portion 56 being pivotally secured to the frame bottom wall 22 by a bottom vertical stub shaft 58. Horizontal movement of boat tiller 48 will obviously cause horizontal rotation of the vertical gimbal ring 54. Pivoted by horizontal pivot shafts 59 to side portions 61 of gimbal ring 54 is the thrust bearing box 60 through which the forward end 62 of propeller shaft 30 is journaled, the thrust bearing box 60 having extending pivot wings 64 pivotally secured to gimbal ring horizontal pivot shafts 59.

Rigidly secured to and extending rearwardly and substantially horizontally from the thrust bearing box 60 is an anti-cavitation plate 66, this plate 66 extending somewhat beyond the super cavitating or surfacing propeller 68 secured on the end of propeller shaft 30 by a nut 70. Secured in a lower center vertical fin 77 depending from the anti-cavitation plate 66 is a propeller end bearing box 72 through which the propeller shaft end is journaled. A center fin 76 extends vertically upward of the plate 66 from the very end thereof to the front propeller shaft thrust bearing box 60, to which it is also secured, thus reinforcing the plate 66 and providing better support for the propeller shaft bearing box 72 and the propeller shaft 30 journaled therethrough.

The thrust bearing box 60 is horizontally pivoted at 59, as already described for vertical swinging movement thereon, and controlled by a hydraulic cylinder 74 and piston rod 78, the piston rod 78 being pivoted to an eye 80 extending from the upper vertical fin 76 and the cylinder 74 is pivotally secured at 82 to a clamp 84 secured on the top end of vertical gimbal ring shaft 50.

Figure 2:
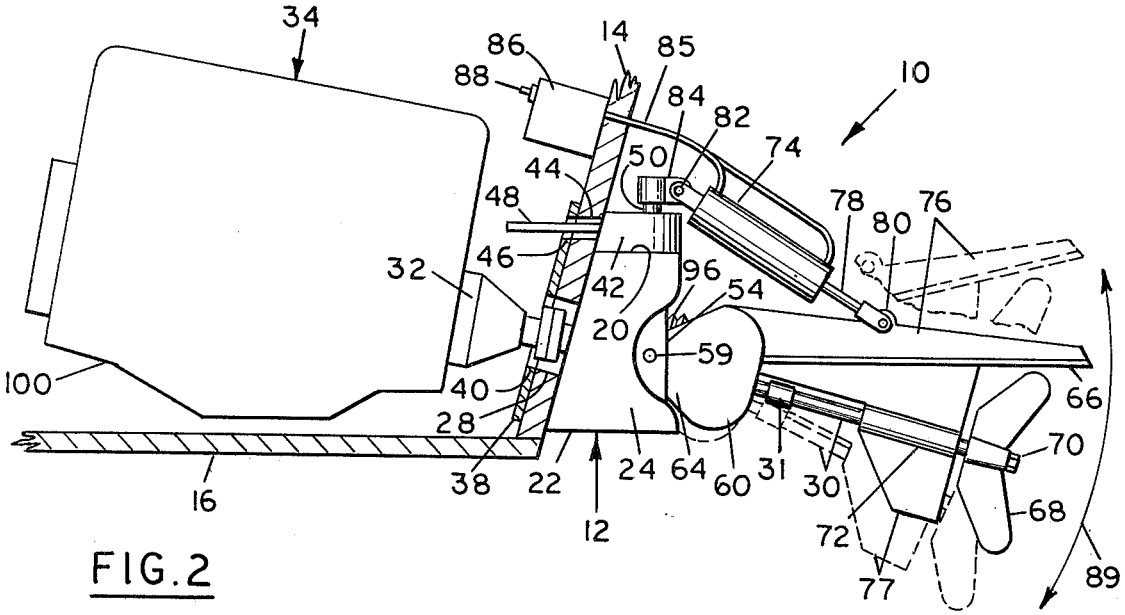
FIG. 2 is a side elevation, including an in-line motor, on a section through the boat wall or transom, also showing the vertical swinging possibility.

A hydraulic pressure hose 85 extends from cylinder 74 to a conventional hydraulic pump 86 having a safety pressure release and pressure valve 88 for vertically swinging and maintaining the piston on the piston rod 78 so as to position the propeller 68 at the desired angle, shown in full in FIG. 2 with the anti-cavitation plate 66 substantially horizontal, with a range of movement shown by the arrow 89 and the dotted lines in FIG. 2. At the top position, the surfacing type propeller 68 will have its bottom tip, when rotating, at least as high as the boat bottom wall or hull 16, so that when the boat is in shallow water just barely enough to float the hull 16, the propeller 68 will be still in a position to drive the boat, though of course not as fast as when in the optimum position.

At the forward or power receiving end 62 of the propeller shaft 30 the shaft 30 is connected by a constant velocity double yoke universal joint 90 to splined shaft 92 providing a strong flexible coupler extending through openings 28 and 40 onto an internally splined female receptacle 94 connected through the gear box 32 to the motor shaft of the boat engine. Obviously, any suitable strong flexible coupler could be used. The constant velocity universal joint 90 permits a greater angle in the shaft than the usual type universal joint which of course is not as efficient.

A sealing tubular accordion boot 96 surrounds the universal coupler 90, 92, 94 to keep it free from water contamination, the boot 96 being sealed at one end to the frame wall aperture cylinder 26 and at its other end to a similar aperture cylinder 98 extending from the bearing box 60.

In FIG. 2, the motor 32 is shown as an in-line motor 100, mounted and secured in any conventional manner at an angle corresponding to the optimum angle of its propeller shaft 30, its coupler 90, 92, 94 permitting any necessary horizontal and vertical swinging movement steering, usually about with 30° either side as shown in FIG. 1, and vertical swinging as shown by arrow 89.

Figure 3:
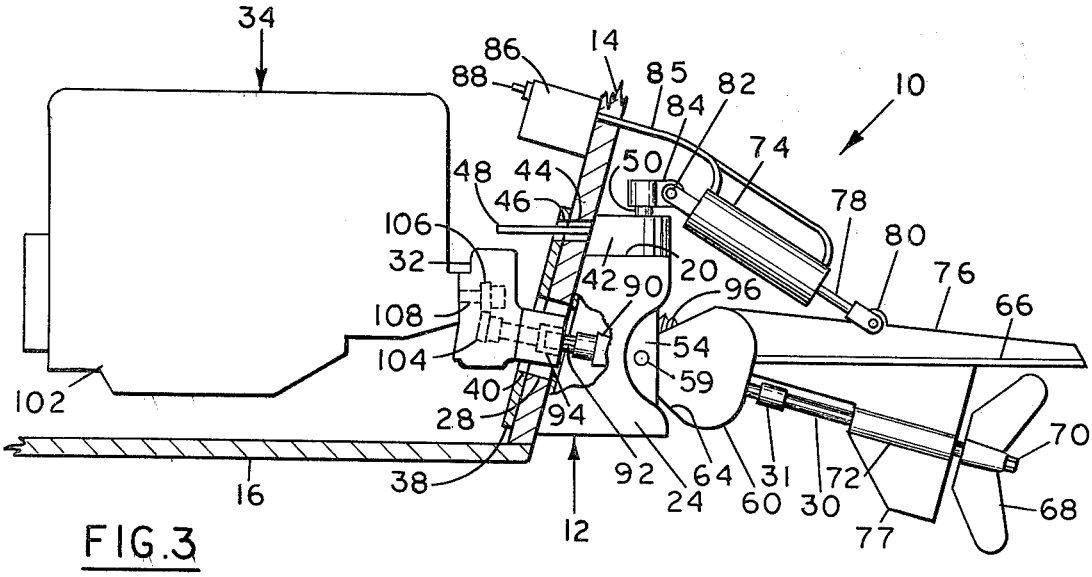
FIG. 3 is a side elevation including a horizontal motor.
Figure 4:
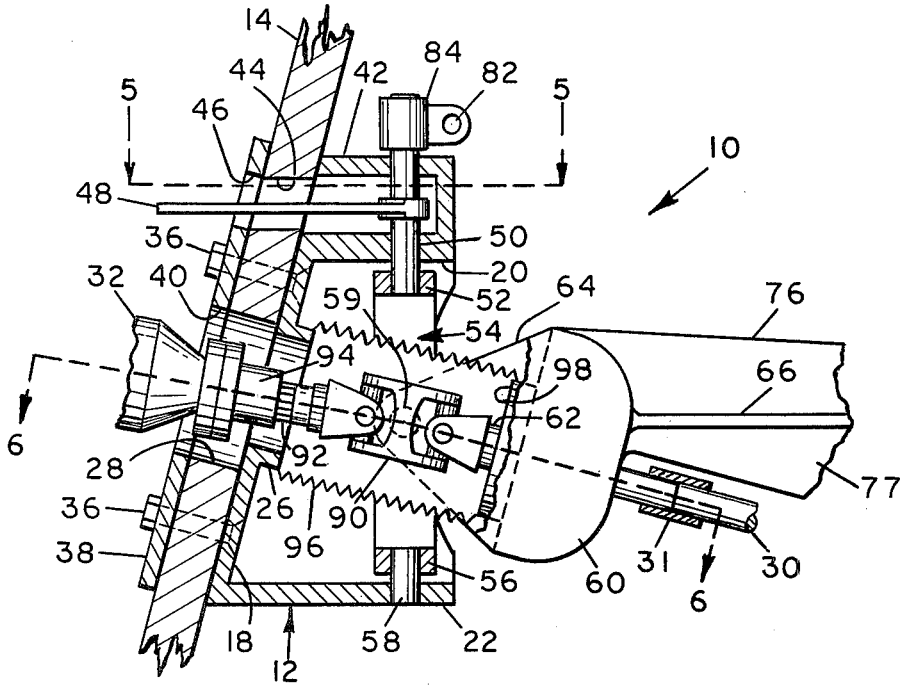
FIG. 4 is a partly sectional side elevation, through the gimbal support frame and boat transom.
Figure 5:
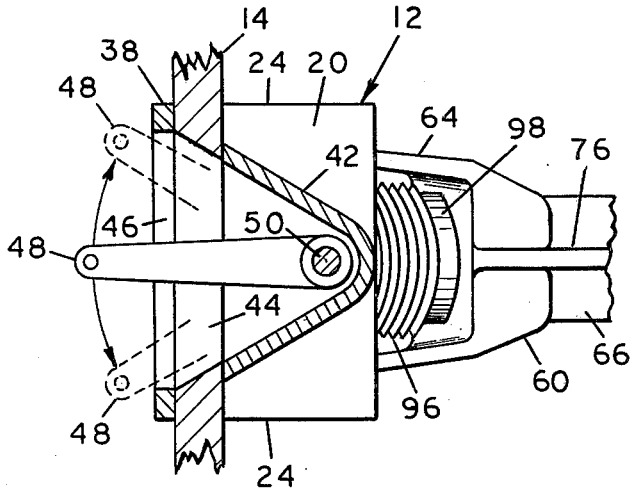
FIG. 5 is a sectional plan view, on line 5—5 of FIG. 4, showing the tiller arrangement.
Figure 6:
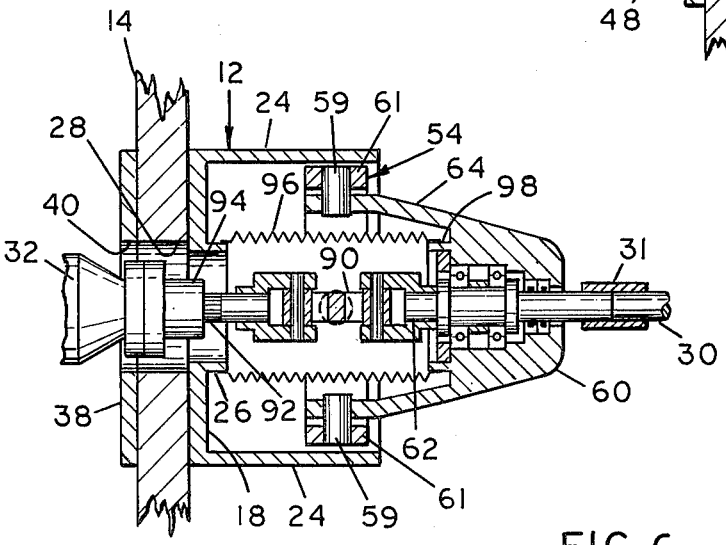
FIG. 6 is a horizontal sectional view on line 6—6 of FIG. 4, showing the gimbal support frame, gimbal and propeller universal joint and sealing boot thereabout.
Figure 7:
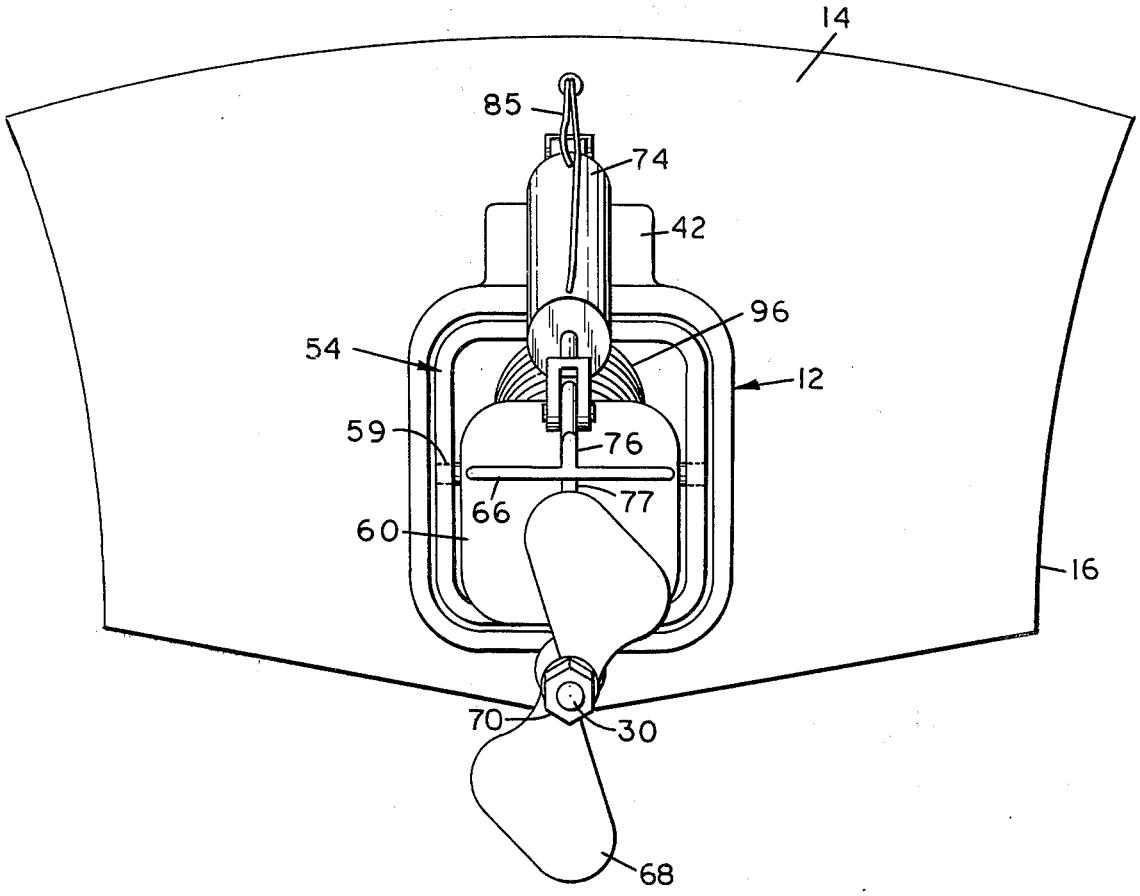
FIG. 7 is a propeller end elevation view, showing a preferred type of surfacing or super cavitating propeller.

In FIG. 3, the motor 34 is shown as a horizontal motor 102, and in addition to the conventional speed reduction gears and gear shafts therein (not shown) the gear 32 also contains bevel gears 104 and 106 at an angle to compensate for the slight angle between the motor shaft 108 and the propeller shaft 30 so that its coupler will have to flex only when its propeller shaft 30 is swung vertically by its hydraulic pressure cylinder, or horizontally by its steering tiller.

In the in-line motor 100, the power thrust is straight at the optimum angle, in the horizontal motor, the power thrust is substantially, but not exactly straight line to the propeller shaft.

ABSTRACT OF THE DRAWINGS

In the drawings, the numbers refer to like parts, and for the purpose of explication, set forth below are the numbered parts of the improved GIMBAL CONTROLLED POWER BOAT MOTOR DRIVE of this invention.

| | | In FIGS. |
|---|---|---|
| 10 | motor drive assembly of this invention | 1–4 |
| 12 | gimbal support frame | 1–6, 7 |
| 14 | boat wall or transom | 2–6, 7 |
| 16 | boat hull | 2, 3, 7 |
| 18 | forward slanted wall of 12 | 1, 4, 6 |
| 20 | frame top wall | 1, 2, 3, 5 |
| 22 | frame bottom wall | 2, 3, 5 |
| 24 | vertical side walls of 12 | 2, 3, 5, 6 |
| 26 | aperture cylinder in frame forward wall 18 | 4, 6 |
| 28 | shaft opening in transom 14 | 2, 3, 4, 6 |
| 30 | propeller shaft | 2, 3, 4, 6, 7 |
| 31 | shaft coupler | 4 |
| 32 | gear shift and gear reduction box | 2, 3, 4, 6 |
| 34 | motor | 2, 3 |
| 36 | frame securing bolts and nuts | 4 |
| 38 | reinforcing plate inside transom 14 | 2–6 |
| 40 | corresponding aperture in plate 38 | 2, 3, 4, 6 |
| 42 | V-shaped tiller compartment on top of frame 12 | 1–5, 7 |
| 44 | tiller opening in transom 14 | 2–5 |
| 46 | tiller opening in plate 32 | 2–5 |
| 48 | boat tiller | 1–5 |
| 50 | tiller shaft | 1–5 |
| 52 | top portion of ring 54 | 4 |
| 54 | vertical gimbal ring | 4, 6, 7 |
| 56 | bottom gimbal ring portion | 4 |
| 58 | vertical bottom stub shaft for 54 | 4 |
| 59 | horizontal pivot shafts for bearing box wings 64 | 2, 3, 4, 6, 7 |
| 60 | thrust bearing box | 1, 2, 3, 4, 6, 7 |
| 61 | side portions of vertical gimbal ring 54 | 4 |
| 62 | forward end of propeller shaft 30 | 3, 4, 6 |
| 64 | pivot wings of 60 | 1, 2, 3, 4, 6 |
| 66 | horizontal anti-cavitation plate | 1–5, 7 |
| 68 | surfacing propeller | 2, 3, 7 |
| 70 | nut on 30 for 68 | 2, 3, 7 |
| 72 | propeller shaft end bearing box | 2, 3 |
| 74 | hydraulic cylinder | 1, 2, 3, 7 |
| 76 | center vertical upper fin | 1–5, 7 |
| 77 | center vertical lower fin | 2, 4, 7 |
| 78 | piston rod | 1, 2, 3 |
| 80 | eye on fin 76 | 1, 2, 3 |
| 82 | cylinder pivot | 1–4 |
| 84 | clamp | 1–4 |
| 85 | hydraulic pressure hose | 1, 2, 3, 7 |
| 86 | pressure pump | 2, 3 |

-continued

| | | In FIGS. |
|---|---|---|
| 88 | pressure valve | 2, 3 |
| 89 | arrow showing vertical movement of 66 | 2 |
| 90 | double yoke universal joint | 3, 4, 6 |
| 92 | splined shaft | 3, 4, 6 |
| 94 | internally splined female receptacle or sleeve | 3, 4, 6 |
| 90, 92, 94 | strong flexible coupler | 3, 4, 6 |
| 96 | sealed tubular accordion boot | 1–6, 7 |
| 98 | aperture cylinder from bearing box 60 | 4, 5, 6 |
| 100 | in-line motor | 2 |
| 102 | horizontal motor | 3 |
| 104 and 106 | bevel gears | 3 |
| 108 | motor shaft | 3 |

Although this invention has been described in considerable detail, such description is intended as being illustrative rather than limiting, since the invention may be variously embodied within the scope of what is claimed.

Having thus set forth and disclosed the nature of this invention, what is claimed is:

1. A unitary direct in-line propelling and steering assembly (10) for an inboard motor (34) of a power boat, said assembly comprising a gimbal support frame (12) to be secured externally to the boat wall or transom (14), a vertically extending gimbal ring (54), pivot shaft means (50, 58) vertically pivoting said ring (54) in said gimbal support frame (12), a propeller shaft thrust bearing box (60), means for pivoting said thrust bearing box (60) on horizontal pivot means (59), in said vertical gimbal ring (54) for vertically swinging said thrust bearing box (60) in said gimbal ring (54), a single propeller shaft (30) journaled through said thrust bearing box (60), a single flexible coupler (90, 92, 94) secured directly on the forward end (62) of said single propeller shaft (30) for connecting said single propeller shaft (30) through an opening (26) in said gimbal support frame (12) and through an aligned opening (28) in the boat transom (14) for connection to the inboard boat motor (34), a second bearing box (72), a common means (66) for mounting said second bearing box (72) spaced from and secured to said first thrust bearing box (60), said single propeller shaft (30) being also journaled through said second bearing box (72) adjacent its propeller rear end, a propeller (68) secured directly on said single propeller shaft (30) rear end, said bearing boxes (60, 72) and said common mounting means (66) maintaining said single propeller shaft (30) in alignment with said single coupler (90, 92, 94), lifting and depressing control means (74, 78, 80, 82, 84, 85, 86, 88) secured to said bearing boxes common mounting means (66) for vertically swinging said single propeller shaft (30), and a tiller (48) secured to said gimbal ring pivot shaft (50) for horizontally swinging said bearing boxes (60, 72), said common mounting means (66), and said single propeller shaft (30) journaled therethrough.

2. The assembly of claim 1, and a tubular accordion sealing boot (96) sealed about said gimbal support frame opening (26) and to said thrust bearing box (60) and enclosing said single flexible coupler (90, 92, 94) therewithin.

3. The assembly of claim 1, said common means (66) for mounting said second bearing box (72) secured to and spaced from said thrust bearing box (60) comprising an anti-cavitation plate (66) secured to said thrust bearing box (60), said second bearing box (72) depending from said anti-cavitation plate (66).

4. The assembly of claim 3, and a vertical fin (76, 77) extending vertically along said anti-cavitation plate (66).

5. The assembly of claim 4, said lifting and depressing control means being secured (80) to said vertical fin (76) at one end and on said tiller pivot shaft (50) at its other end.

6. The assembly of claim 5, said propeller shaft lifting and depressing control means comprising a hydraulic pressure cylinder (74) and piston, and hydraulic pressure supply (86) and control means (88) connected to said hydraulic pressure cylinder (74).

7. The assembly of claim 1, said gimbal support frame (12) having a V-shaped horizontal pocket (42) with its apex about said tiller pivot shaft (50) and its open end complementary to a corresponding tiller passage opening (44, 46) through the boat wall or transom (14), said V pocket (42) being approximately 60° in horizontal width.

8. The assembly of claim 1, said propeller being a surfacing propeller (68).

9. The assembly of claim 1, and a tubular accordion sealing boot (96) sealed to and secured to said gimbal support frame (12) about said frame opening (26) and to said thrust bearing box (60) about said single propeller shaft (30) forward end (62) therethrough and enclosing said single flexible coupler (90, 92, 94) therewithin.

10. The assembly of claim 9, said flexible coupler including a single universal joint (90).

11. The assembly of claim 1, said flexible coupler including a splined shaft (92) and an internally splined sleeve (94).

12. The assembly of claim 1, said flexible coupler including a single universal joint (90) of the double yoke type.

13. The assembly of claim 1, said single flexible coupler comprising a double yoke universal joint (90) and a splined shaft (92) and an internally splined sleeve (94) receptacle for said splined shaft.

14. The assembly of claim 4, said vertical fin extending above (76) and below (77) said anti-cavitation plate (66).

15. The assembly of claim 14, said second bearing box (72) being secured to and depending from said lower vertical fin (77).

* * * * *

UNITED STATES PATENT OFFICE

CERTIFICATE OF CORRECTION

Patent No. 3,933,116 Dated January 20, 1976

Inventor(s) Thomas F. Adams et al.

It is certified that error appears in the above-identified patent and that said Letters Patent are hereby corrected as shown below:

In the Abstract, line 19, the slant mark (/) between "bove" and "and" should be deleted.

Claim 1, column 5, line 30, before "in" delete the comma.

Signed and Sealed this

*twenty-seventh* Day of *April 1976*

[SEAL]

*Attest:*

RUTH C. MASON
*Attesting Officer*

C. MARSHALL DANN
*Commissioner of Patents and Trademarks*